United States Patent [19]

Suzuki

[11] Patent Number: 4,858,734

[45] Date of Patent: Aug. 22, 1989

[54] SLIDE TYPE EXHAUST BRAKE SYSTEM

[75] Inventor: Ryoichi Suzuki, Mishima, Japan

[73] Assignee: Usui Kokusai Sangyo Kaisha Ltd., Sunto, Japan

[21] Appl. No.: 276,208

[22] Filed: Nov. 23, 1988

[30] Foreign Application Priority Data

Nov. 25, 1987 [JP] Japan ..... 62-297166

[51] Int. Cl.[4] ..... F02D 9/06

[52] U.S. Cl. ..... 188/273; 137/338

[58] Field of Search ..... 137/338; 188/154, 273; 251/326

[56] References Cited

U.S. PATENT DOCUMENTS

| | | | |
|---|---|---|---|
| 742,308 | 10/1903 | Gerrard . | |
| 795,057 | 7/1905 | O'Brien . | |
| 1,436,412 | 11/1922 | Skiffington . | |
| 1,620,100 | 3/1927 | Hoxton . | |
| 2,845,306 | 7/1958 | Carver . | |
| 3,342,203 | 9/1967 | Abercrombie . | |
| 3,720,227 | 3/1973 | Curran . | |
| 4,062,332 | 12/1977 | Perr . | |
| 4,093,046 | 6/1978 | Perr | 188/273 |
| 4,205,704 | 6/1980 | Benson . | |
| 4,408,627 | 10/1983 | Harris | 137/242 |
| 4,452,269 | 6/1984 | Kindermann | 137/338 |
| 4,553,648 | 11/1985 | Suzuki et al. | 188/273 |
| 4,615,354 | 10/1986 | Bianchi | 137/110 |
| 4,671,489 | 6/1987 | Jankovic | 251/327 |
| 4,685,544 | 8/1987 | Takigawa et al. | 188/273 |
| 4,733,687 | 3/1988 | Takigawa et al. | 137/338 |
| 4,751,987 | 6/1988 | Takigawa et al. | 188/273 |

FOREIGN PATENT DOCUMENTS

| | | |
|---|---|---|
| 3009453 | 9/1981 | Fed. Rep. of Germany . |
| 2223602 | 10/1974 | France . |
| 55-117047 | 9/1980 | Japan . |
| 55-123328 | 9/1980 | Japan . |
| 55-123330 | 9/1980 | Japan . |
| 60-3437 | 9/1985 | Japan . |
| 14098 | of 1891 | United Kingdom . |

*Primary Examiner*—Duane A. Reger

*Attorney, Agent, or Firm*—Anthony J. Casella; Gerald E. Hespos

[57] ABSTRACT

There is disclosed a slide type exhaust brake system having: an exhaust brake body orthogonal to an exhaust passageway provided with a protrudent connecting wall to an air release pipe; and air cylinder leading to one end of the brake body; a tabular valve member incorporated into a reciprocatory operation passageway and fitted to a tip of a piston rod penetrating a partition wall with respect to the air cylinder unit; a block member engaging with the valve member; and an exhaust pressure adjusting hole communicating with an engagement port. When closing the exhaust passageway, the exhaust pressure adjusting hole is closed substantially by the tip of the piston, keeping a minute spacing with respect to a peripheral surface of the engagement port. The peripheral surface of the exhaust pressure adjusting hole undergoes a unidirectional thrust by the piston tip. When opening the exhaust passageway, the exhaust pressure adjusting hole is opened substantally by the piston tip. The block member moves the valve member in the other direct. Thus the braking functions smoothly and rapidly.

5 Claims, 3 Drawing Sheets

SLIDE TYPE EXHAUST BRAKE SYSTEM

BACKGROUND OF THE INVENTION

1. Field of the Invention:

The present invention relates to an improvement of a slide type exhaust brake system, connected to the middle of an air release pipe, for imparting braking effects to a vehicle by blockading an exhaust passageway for an exhaust gas running through the air release pipe on the occasion of a sharp descent, typically in a large-sized vehicle such as a truck or a bus.

2. Description of the Prior Art:

This type of conventional exhaust brake system is, as illustrated in FIG. 7, arranged such that: a value mechanism unit is composed of a tabular valve member (13) incorporated into a reciprocatory operation passageway provided in an exhaust brake body, and an auxiliary valve member (17) based on a liner (19) buffer-fitted to a block member (15) engaging with the valve member (13) fixed on the side of the tip of a piston rod (16) and to a lower surface of the block member, which liner (19) slides on the continuous surface of the valve member, the valve member (13) having its bottom wall formed with an exhaust pressure adjusting hole (14) passing therethrough. When opening and closing the exhaust passageway, the tip of the piston rod (6) engages with the fitting portion of the valve member in combination with the block member (15) and an intermediate wall provided on the side of the valve member (13) to effect a downward thrust and lifting. The exhaust passageway is thus opened and closed.

Note that the numeral (14') represents a small-diameter exhaust gas escape hole for preventing an excessive load created when closing the passageway.

There arise, however, the following problems inherent in the prior art valve mechanism unit. The processing becomes quite complicated, which leads to an obstacle to the workability, due to factors suchas: the accurate working associated with requirements for obtaining tightfitting with respect to the narrow slide surface; and configurations of the exhaust pressure adjusting hole (14) penetrating a bottom wall and of the escape hole (14') in regards to a size of the valve member (13) accomodated in the limited space. Besides, the strength of the valve mechanism unit is deteriorated. Since the exhaust pressure adjusting hole (14) is not allowed to have a large diameter, there is not yet attained a drop in exhaust pressure of the exhaust pressure adjusting hole opened in advance of opening the exhaust passageway. In general, the braking function tends to be short of smoothness as well as of rapidness. Because of the fitting (18) to the block member (15) and of a structure of allowing for a relatively narrow width of the liner (19), there are easily caused local abrasion on the mutual slide surfaces or a play due to one-sided impingement. Hence, it follows that a life span of the product diminishes, and the valve mechanism unit does not have a long stretch of durability for the reason of highly frequent repetition of opening and closing operations when being used.

SUMMARY OF THE INVENTION

It is a primary object of the present invention to provide a slide type exhaust brake system which has a long stretch of durability and is capable of alleviating and preventing mutual abrasion or a play attributed to one-sided impingement by such an arrangement that: the processing can remarkably be facilitated by eliminating operations of setting a position and a direction of an exaust pressure adjusting hole and also providing no tightfitting thereof; it is unnecessary to form an escape hole and the exhaust pressure adjusting hole in a bottom wall on the side of a valve member in the prior art, and an anxiety for deterioration in strength of the valve member itself is thereby eliminated; a relatively large diameter design can readily be attained in the exhaust pressure adjusting hole to exhibit a sufficient drop in exhaust pressure, resulting in a smooth and rapid braking function; it is not required to separately provide an auxiliary valve member; and there is provided a structure of opening and closing the exhaust pressure adjusting hole by employing the piston rod tip.

To this end, according to one aspect of the invention, there is provided a slide type exhaust brake system arranged such that: a brake body includes a reciprocatory operation passageway formed in the direction substantially orthogonal to an exhaust passageway provided with a protruded connecting wall to an exhaust pipe at both ends thereof; a tabular valve member incorporated into the reciprocatory operation passageway is buffer-fitted to the tip of the piston rod penetrating a partition wall with respect to an air cylinder leading to one end portion of the reciprocatory operation passageway; a block member engaging with the valve member is interposed in and fixed to a portion vicinal to the tip of the piston rod; formed in an intermediate wall on the side of the valve member is an exhaust pressure adjusting hole communicating with an engagement port formed on an axial line in such a direction that the piston rod is movable up and down; when closing the exhaust passageway in the valve member, the exhaust pressure adjusting hole is closed by the portion vicinal to the tip of the piston rod, keeping a minute flowage spacing formed in connection with the peripheral surface of the engagement port; the peripheral surface of the exhaust pressure adjusting hole undergoes a unidirectional thrust given by the tip of the piston rod; when opening the exhaust passageway, the exhaust pressure adjusting hole communicating with the engagement port is opened by the portion vicinal to the tip of the piston rod; and the block member serves to move the valve member in the other direction. Based on the construction, the exhaust pressure adjusting hole communicating with the engagement port is formed to assume an L-shape or a T-shape in section. The engagement port open to the tip of the piston rod assumes a round or elliptical configuration. The peripheral surface of the tip of the piston rod is formed in a tapered conical configuration or a top-elliptically-conical configuration in order to provide a tapered minute spacing with respect to the peripheral surface of the engagement port.

The slide type exhaust brake system according to the present invention is so constituted that the exhaust pressure adjusting hole communicating with the engagement port on the axial line in the moving direction of the piston rod is formed in the intermediate wall of the valve member; and the peripheral surface of the exhaust pressure adjusting hole is subjected to a pressing force, keeping the minute flowage spacing with respect to the peripheral surface of the engagement port when closing the passageway. As a result, it is possible to remarkably facilitate the processing in terms of eliminating the operations of setting a position and a direction of the exhaust pressure adjusting hole and also providing no tightfitting thereof. An exhaust gas escape hole and the exhasut pressure adjusting hole in the bottom wall in the prior art are made unnecessary in regards to a size of the valve member accomodated in the limited space, thereby making it possible to eradicate an anxiety for deterioration in strength of the valve member itself. In addition, if necessary, the exhaust pressure adjusting hole may readily be shaped to have a large diameter, and a sufficient drop in exhaust pressure can thereby be obtained. an effective area through which the exhaust gas passes sharply increases with small variations in stroke especially becauase of forming a tapered minute spacing, thereby increasing a velocity at which the exhaust pressure falls. This permits the braking to function smoothly and rapidly. By virtue of a structure of opening and closing the exhaust pressure adjusting hole by use of the piston rod, it is feasible to alleviate and prevent mutual abrasion and a play due to one-sided impingement. Therefore, considerably long durability can be acquired.

Other objects and advantages of the invention will become more apparent during the following discussion in conjunction with the accompanying drawings.

BRIEF DESCRIPTION OF THE DRAWINGS

FIG. 5(A) is a plan view illustrating a hole-open-state; FIG. 5(B) is a plan view showing the hole-closing-state;

DETAILED DESCRIPTION OF THE PREFERRED EMBODIMENTS

Figure 1:
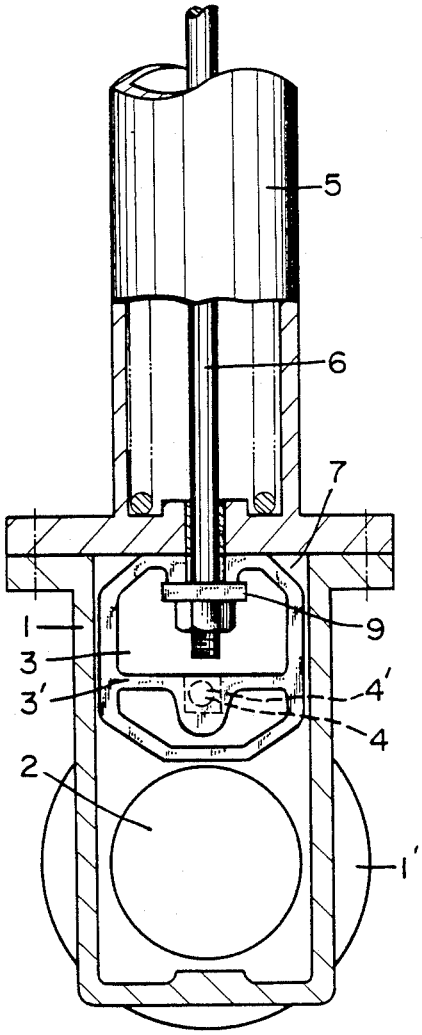
FIG. 1 is a partially cut-away plan view of a slide type exhaust brake system, showing one embodiment of the present invention.

Referring to FIGS. 1 through 6, an exhaust brake body generally designated at (1) includes a reciprocatory operation passageway (7) for a tabular valve member (3), the passageway (7) being formed in the direction substantially orthogonal to an exhaust passageway (2), out of which a connecting wall (1') to an exhaust pipe is protruded at both ends thereof. A valve member (3) incorporated into the reciprocatory operation passageway (7) of the brake body is fitted to the tip of a piston rod penetrating a partition wall with respect to an air cylinder unit (5) provided in connection with the upper end portion of the reciprocatory operation passageway. Interposed in and fixed to a portion vicinal to the tip of the piston rod (6) is a block member (9) engaging with the valve member. The reference numeral (3') denotes an intermediate wall provided on the side of the valve member (3). The intermediate wall (3') is formed with an exhaust pressure adjusting hole (4) communicating with an engagement port (4') so provided that its central line is positioned on the axial line in such a direction as to make the piston rod (6) movable up and down. The numeral (8) represents a minute flowage spacing formed along the peripheral surface of the engagement portion (4') with respect to the tip portion of the piston rod (6), the arrangement being such that when closing the exhaust passageway (2) by use of the valve member (3), the tip of the piston rod (6) pushes down the peripheral surface of he exhaust pressure adjusting hole (4), thus closing the exhaust pressure adjusting hole (4). The spacing serves to admit an escape of the exhaust gas for preventing an excessive load on the machine body. If necessary, the spacing may be formed to assume a tapered configuration. In the case of opening the exhaust passageway, the exhaust pressure adjusting hole (4) communicating with the engagement port (4') in the vicinity of the tip of the piston rod (6) is opened, and at the same moment the block member (9) engages with the fitting portion of the valve member, thereby raising the valve member.

Figure 4:
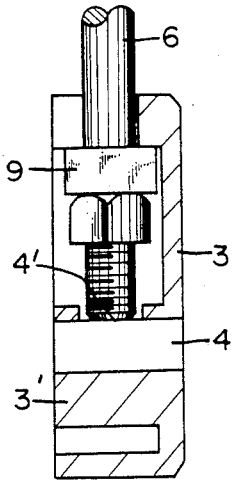
FIG. 4 is a view similar to FIG. 3, illustrating another embodiment of the present invention.
Figure 3:
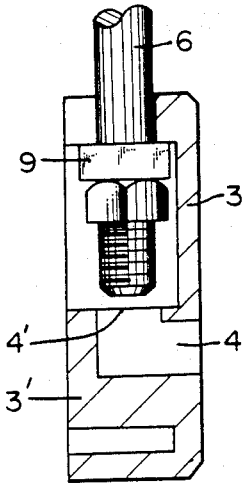
FIG. 3 is a view of assistance in explaining a state where the hole is opened in FIG. 2.
Figure 5A:
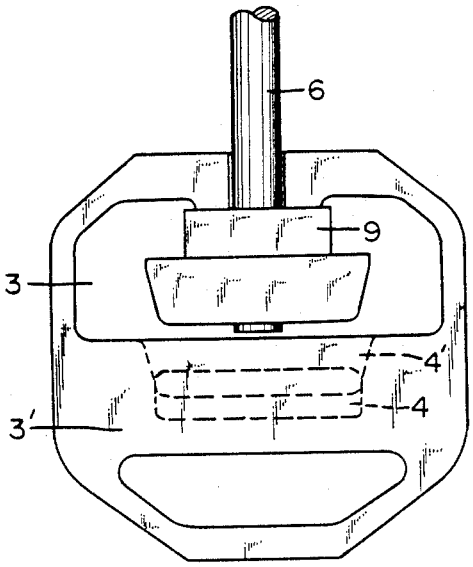
FIGS. 5(A) and 5(B) in combination show a valve mechanism unit in still another embodiment of the present invention.
Figure 5:
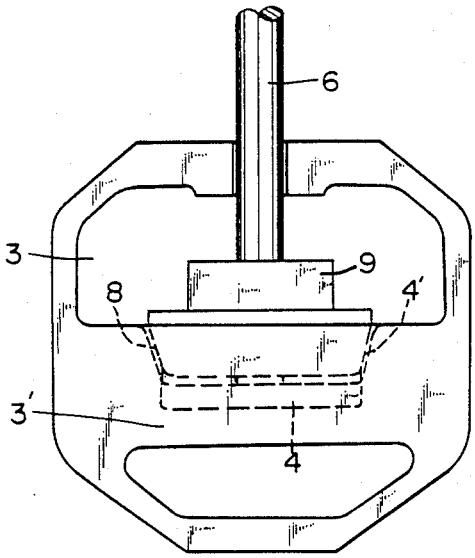
Figure 6A:
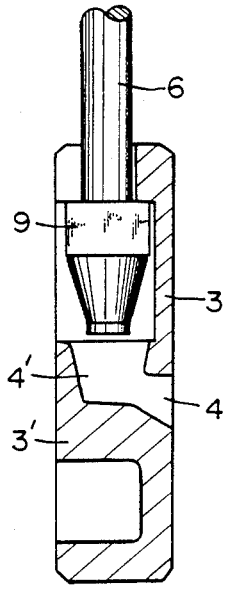
FIGS. 6(A) and 6(B) are partially cut-away sectional views of FIGS. 5(A) and 5(B)
Figure 6B:
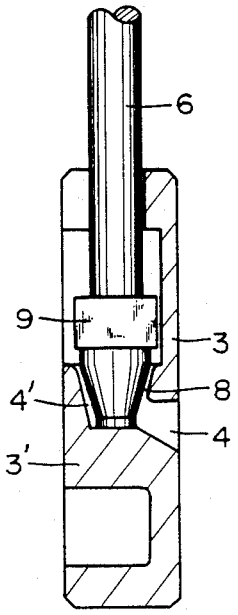
Figure 7:
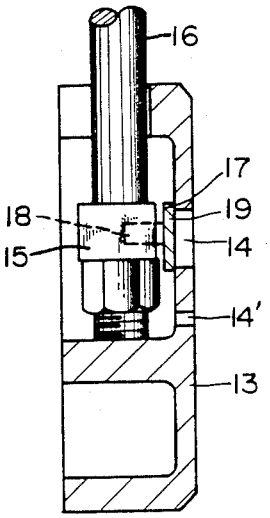
Fig. 7 PRIOR ART
FIG. 7 is a vertical sectional view of a valve mechanism with portions broken away, showing a conventional example.

The exhaust pressure adjusting hole (4) communicating with the engagement port (4') is formed to assume an L-shape in section (FIGS. 1, 2, 3, 5 and 6) or a T-shape in section (FIG. 4). The engagement port (4') is formed in a tapered round (not illustrated) open to the tip of the piston rod (6) or in a elliptical configuration (FIGS. 5 and 6) as well as in the round-shape (FIGS. 1 to 4). The tip peripheral surface of the piston rod (6) is formed in a cylindrical configuration (FIGS. 1 to 4) or in a tapered conical shape (not shown) or in a top-elliptically-conical configuraiton.

Figure 2:
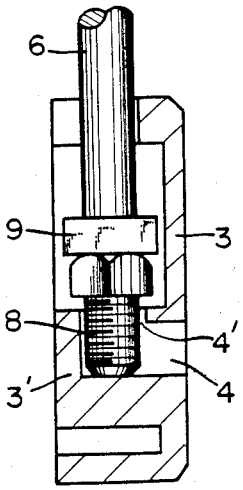
FIG. 2 is a partially cut-away enlarged sectional view illustrating a valve mechanism unit associated with the principal portion according to the present invention when closing a hole.

Such an arrangement is characteristic of the present invention. When closing the exhaust passageway by the valve member (3), as depicted in FIG. 2, the minute flowage spacing (8) is defined by the peripheral surface of the engagement port (4') and by the portion vicinal to the tip of the piston rod (6), in which state the tip thereof thrusts down the peripheral surface of the exhaust pressure adjusting hole (4). The exhaust passageway is thus closed. Before opening the exhaust passageway, as shown in FIGS. 3 through 6, the portion vicinal to the tip of the piston rod (6) acts to open the exhaust pressure adjusting hole (4) communicating with the engagement port (4), and the block member (9) engages with the valve member (3), thereby raising the valve member.

Although the illustrative embodiments of the present invention have been described in greater detail with reference to the accompanying drawings, it is to be understood that the invention is not limited to those precise embodiments. Various changes or modifications may be effected therein by one skilled in the art without departing from the scopeor spirit of the invention.

What is claimed is:

1. A slide type exhaust brake system comprising:

an exhaust brake body having a connecting wall defining an exhaust passageway and having an operation passageway extending into the exhaust passageway;

a cylinder unit mounted proximate to said exhaust brake body, said cylinder unit including a cylinder and a piston rod having an end, said piston rod being reciprocally movable in the operation passageway into and out of the cylinder, and a block intermediate the end of the piston rod and the cylinder; and a tabular valve member slidably mounted in said exhaust brake body and slidably mounted to said piston rod such that a portion of the tabular valve member is intermediate the block and the cylinder, said tabular valve member having an intermediate wall transverse to the piston rod, an exhaust pressure adjusting hole extending through the tabular valve member and communicating with an engagement port in said intermediate wall and axially aligned with the end of the piston rod, said engagement port being dimensioned to be substantially closed by the end of the piston rod, the movement of the piston rod out of the cylinder moving the end of the piston rod into the intermediate wall to substantially block the exhaust pressure adjusting hole and to urge the tabular valve member into the exhaust passageway, the movement of the piston rod into the cylinder moving the end of the piston rod out of the engagement port and urging the block into the tabular valve member for moving the tabular valve member out of the exhaust passageway.

2. A brake system as set forth in claim 1, wherein said exhaust pressure adjusting hole communicating with said engagement port is formed to assume an L-shape in section.

3. A brake system as set forth in claim 1, wherein said exhaust pressure adjusting hole communicating with said engagement port is formed to assume a T-shape in section.

4. A brake system as set forth in claim 1, wherein said piston includes a tapered member adjacent said engagement port.

5. A brake system as set forth in claim 1, wherein said end of said piston rod includes an elongated member extending transverse to said piston rod and being formed in a tapered configuration dimensioned to define a tapered minute spacing with respect to a peripheral surface of said engagement port.

* * * * *